United States Patent [19]

Ohm et al.

[11] Patent Number: 4,841,931

[45] Date of Patent: Jun. 27, 1989

[54] METHOD OF ADJUSTING A CONTROLLING ELEMENT AND CIRCUIT ARRANGEMENT FOR THE CARRYING OUT OF THE METHOD

[75] Inventors: Heinz-Friedrich Ohm, Weiterstadt; Klaus Bluhm, Steinbach/Ts.; Hans-Günter Appel, Bad Soden; Kurt Probst, Schwalbach, all of Fed. Rep. of Germany

[73] Assignee: VDO Adolf Schindling AG, Frankfurt, Fed. Rep. of Germany

[21] Appl. No.: 185,499

[22] Filed: Apr. 25, 1988

[30] Foreign Application Priority Data

May 9, 1987 [DE] Fed. Rep. of Germany ..... 3715557

[51] Int. Cl.[4] ..... F02D 41/08

[52] U.S. Cl. ..... 123/339; 123/352; 123/361; 123/399

[58] Field of Search ..... 123/339, 361, 399, 585, 123/352

[56] References Cited

U.S. PATENT DOCUMENTS 4,730,264 3/1988 Kohler ..... 123/361 X 4,736,722 4/1988 Ciampolini et al. ..... 123/361 X

*Primary Examiner*—Tony M. Argenbright

*Attorney, Agent, or Firm*—Martin A. Farber

[57] ABSTRACT

In the method for adjusting a controlling element, a marking point which can be recognized by the controller unit which controls the controlling element and is at a given distance from the adjustment point is selected in the vicinity of the desired adjustment point, said distance corresponding to a given number of control pulses which are necessary in order to adjust the controlling element with close tolerances to the desired adjustment point. When a switch is used as the marking point, the distance should be so great that after movement beyond this marking point the switch passes into a precisely defined switch condition.

2 Claims, 1 Drawing Sheet

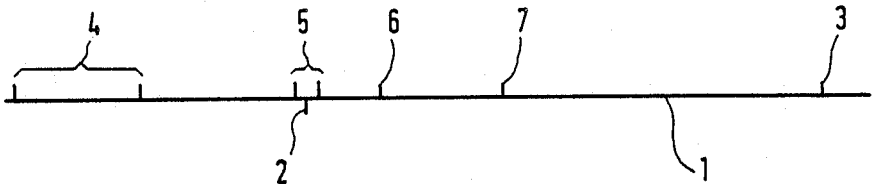
4
5
6
7
3
2
1

METHOD OF ADJUSTING A CONTROLLING ELEMENT AND CIRCUIT ARRANGEMENT FOR THE CARRYING OUT OF THE METHOD

FIELD AND BACKGROUND OF THE INVENTION

The invention refers to a method for the adjustment to a given adjustment point of a controlling element which serves to actuate a displacement device, for instance a throttle valve, in order to control the engine output of an internal combustion engine, the controlling of the controlling element being effected by an electronic automatic controller unit by means of which the controlling element can be acted on by a train of control pulses.

In internal combustion engines it is necessary for various reasons that, for instance, the idling speed of rotation be always reached again with the smallest possible tolerances during the operation of the internal combustion engine. This is necessary, for instance, in order to prevent stalling of the internal combustion engine and in order to limit the fuel consumption to a minimum.

Since the speed of the controlling element is proportional to the control by the automatic controller unit, different final positions below the desired idling speed of rotation can be obtained without special measures, which is due to the over-run of the controlling element which customarily comprises a dc motor.

SUMMARY OF THE INVENTION

It is an object of the invention upon the controlling of the idling speed of rotation to achieve this idling speed of rotation in all cases as exactly as possible from the most different operating conditions of the internal combustion engine.

According to the invention a marking point which is recognized by the controller unit and which is at a specified distance from the desired adjustment point, which corresponds to at least one entire control pulse for the moving of the controlling element for the displacement of the controlling element from the marking point to the adjustment point, is selected and the controlling element, after a first passage of the controlling element beyond the marking point and stopping, is moved back with constant control pulses past the marking point, whereupon the marking point is then again passed over in the direction towards the adjustment point, the controlling element being acted on, as from the marking point, with as many defined control pulses as corresponds to the selected distance from the adjustment point.

Further according to the invention, the marking point is defined by a switch and the distance of the marking point from the adjustment point is selected so large that the switch, after the passage over the marking point in the direction towards the adjustment point, upon reaching the latter assumes an unambiguously defined switch condition, for instance a completely open condition.

The essence of the invention consists in the selection of a marking point and in the use of a controller electronic system which is able to recognize this marking point in order then so to act on the controlling element with defined control pulses that the controlling element, after passing the marking point, as from its stoppage is moved back beyond the marking point, stopped, and then again moved back beyond the marking point in the direction towards the desired adjustment point which corresponds to the specified idling speed of rotation, this being done with a number of control pulses which is necessary in order to reach precisely the selected distance from the marking point. This is necessary, in particular, when a switch is selected as marking point so that this switch can come into a well-defined switch condition, for instance into completely open condition in order to prevent burning of the switch contacts. As a result of this manner of operation, it is possible to reach the desired adjustment point, i.e. the desired idling speed of rotation, again and again in reliable manner regardless of whether the controlling element is moved with high speed or low speed, which depends on its prior control. Thus, for example, the controlling element, if it was previously in the full-load condition, is moved with higher speed in the direction towards the idling speed of rotation than if the distance before the starting of the return process to the idling speed of rotation is less and the internal combustion engine therefore was operating, for instance, in the partial-load region.

BRIEF DESCRIPTION OF THE DRAWING

With the above and other objects and advantages in view, the present invention will become more clearly understood in connection with the detailed description of a preferred embodiment, when considered with the accompanying drawing, of which:

The only FIGURE of the drawing shows the range of speed of rotation of an internal combustion engine and thus the range of control of the controlling element as well as various specific position points of the controlling element upon the displacement thereof upon the control of the idling speed of rotation.

DETAILED DESCRIPTION OF THE PREFERRED EMBODIMENT

As can be noted from the drawing, the idling speed of rotation designated by 2 and the full-load speed of rotation by 3 on a line 1 which represents both the range of speed of rotation of an internal combustion engine and the range of movement of a controlling element. Upon the controlling of the controlling element in order, for instance, to move it from its full load position 3 into the idling position 2, the controlling element, which for instance comprises a dc motor, is controlled by a controller unit in order to obtain this course of movement. Because of the over-run of the motor the latter, if no special measures are taken, will run past the idling point 2 and come to a stop, for instance, only in a region below the idling speed of rotation, designated 4 in the drawing. In order now so to adjust the controlling element that after the conclusion of the adjusting process it is located within a narrow region 5 in the vicinity of the adjustment point for the desired idling speed of rotation, there is selected a marking point, designated 6, which is at a given distance from the point 2 which represents the exact idling speed of rotation. The marking point 6 is above the desired idling speed of rotation, referred to the speed of rotation of the internal combustion engine. The controlling element after it has stopped after the aforementioned process of movement, is in the region 4, moved by the controller unit past the marking point and is stopped after recognition of the marking point. After this control process, the controlling element is, for instance, at the point 7. From here the controlling element is moved back with precisely defined control pulses beyond the marking point 6 in the direction towards the desired adjustment point 2 corresponding to the desired idling speed of rotation. As from the reaching of the marking point 6 which the controller electronic system again recognizes, the controlling element is controlled with as many control pulses as corresponds to the previously established distance between the points 6 and 2. This distance and the corresponding control pulses are so selected that, for instance, a switch representing the marking point definitely passes into a well-defined switch condition, in the present case into its fully open switch condition. In this way, one avoids having the switch in a merely slightly open state upon the stopping of the controlling element, which would lead to a burning of the switch contacts.

By the method of the invention, therefore, the controlling element is moved from its instantaneous position very rapidly in the direction towards the desired idling speed of rotation, i.e. towards the desired adjustment point 2, as a result of which it initially passes beyond said point as a result of the over-run effect. The controlling element is then moved back beyond the marking point to point 7 in order then to be moved with low speed corresponding to constant control pulses again past the marking point 6 in the direction towards the adjustment point 2. As from the adjustment point 2 which the controller unit recognizes, a precisely defined starting position is then established from which the controlling element can be moved with constant control pulses exactly to the adjustment point. Since in this state of movement the controlling element moves only with very slow speeds, as is possible because the distance from the desired adjustment point is very small, the aforementioned over-run effect is avoided and the controlling element can be stopped with very narrow tolerances at the desired adjustment point 2. In this way, a very precise return of the controlling element to the adjustment point and thus to the idle setting point is possible, which leads to the above-indicated advantage in connection with a precise idling speed of rotation which is to be seen in the fact that the stalling of the internal combustion engine is avoided and minimum fuel consumption is achieved since, due to the precise adjustability of the idling speed of rotation, the latter can be pushed so far downward that the engine barely does not stall. In this way a minimum consumption of fuel upon idling is assured.

We claim:

1. A method for providing adjustment to a given adjustment point of a controlling element which serves to actuate a displacement device in order to control the engine output of an internal combustion engine, a controlling of the controlling element being effected by an electronic automatic controller unit which acts upon the controlling element by a train of control pulses, the method comprising steps of selecting a marking point for the controller unit at a specified distance from a desired adjustment point for at least one entire control pulse, the marking point serving for moving a correcting element to displace the controlling element from a marking point up to an adjustment point;

moving back the controlling element, after a first passage of the controlling element beyond the marking point and stopping, with constant control pulses past the marking point; and passing over the marking point in a direction towards the adjustment point, the controlling element being acted on, from the marking point, with as many defined control pulses as corresponds to a selected distance from the adjustment point.

2. A method according to claim 1, wherein the marking point is defined by a switch and the distance of the marking point from the adjustment point is selected so large that the switch, after a passage over the marking point in a direction towards the adjustment point, upon reaching the latter assumes an unambiguously defined switch condition.

* * * * *